United States Patent [19]

Krauland

[11] Patent Number: 4,881,444

[45] Date of Patent: Nov. 21, 1989

[54] METHOD AND APPARATUS FOR BRAIDING THREE-DIMENSIONAL FABRICS

[76] Inventor: Konrad L. Krauland, 15542 Toway La., Huntington Beach, Calif. 92647

[21] Appl. No.: 211,479

[22] Filed: Jun. 24, 1988

[51] Int. Cl.[4] ..... D04C 1/06; D04C 3/00

[52] U.S. Cl. ..... 87/8; 87/1; 87/7; 87/33

[58] Field of Search ..... 87/1, 5, 7, 8, 9, 11, 87/33, 34; 139/11, 13 R, 16

[56] References Cited

U.S. PATENT DOCUMENTS 3,426,804 2/1969 Bluck ..... 87/33 X 4,312,261 1/1982 Florentine ..... 87/33

4,621,560 11/1986 Brown et al. ..... 87/8

4,719,837 1/1988 McConnell et al. ..... 87/33 X

*Primary Examiner*—John Petrakes

*Attorney, Agent, or Firm*—Kane, Dalsimer, Sullivan, Kurucz, Levy, Eisele and Richard

[57] ABSTRACT

A three-dimensional fabric is braided with an apparatus having a floating yarn creel and a floating forming plate, each having movable elements. Fibers are fed from the creel through the forming plate to a forming zone where the fibers are braided by synchronous movements of said movable elements. Beaating combs may also be provided in the forming zone.

20 Claims, 7 Drawing Sheets

METHOD AND APPARATUS FOR BRAIDING THREE-DIMENSIONAL FABRICS

BACKGROUND OF THE INVENTION

1. Field of Invention

This invention pertains to a method and apparatus for braiding three-dimensional re-enforced fabrics, these types of fabrics are gaining popularity as structural members in the aerospace industry and other industries requiring very light yet durable materials. Composites reinforced with 3-D fabrics exhibit greater isotropy and fracture toughness than those made with conventional cloth or fiber lay-ups.

2. Description of the prior art

The term THREE-DIMENSIONAL FABRIC refers to textile assemblies with interlaced yarns extending into all three dimensions, eliminating non-reinforced planes within a structure. Non-reinforced planes are the weakest segments in a composite structure. Structural faults such as cracking and delamination tend to propagate along these non-reinforced planes.

Three-dimensional braiding devices are disclosed in U.S. Pat. Nos. to Bluck (3,426,804); Florentine (4,312,261) and Brown (4,621,560). The devices disclosed therein have several common characteristics:

1. The zone in which the fabric is formed, hereinafter called the braiding zone, is relatively long in the longitudinal direction;

2. No provision is made to compensate for slack yarns in the braiding zone resulting in movement of the braiding blocks from the perimeter to the center of the braiding matrix.

3. No means are provided for beating or compacting yarn interlacings to form the fabric either within or adjacent to the braiding zone.

In addition, Florentine discloses magnetic means for positioning the braiding elements in a pre-selected orientation, which makes the device expensive and complex. Brown discloses a device which merely provides a means for aligning elements in the braiding plane to prevent jamming during weaving.

OBJECTIVES AND SUMMARY OF THE INVENTION

In view of the abovementioned disadvantages of the art, it is an objective of the present invention to provide an apparatus and method which can be used to continuously and automatically braid a fabric with fibers oriented in three dimensions, eliminating any non-reinforced planes within the structure.

A further objective is to provide an apparatus and method which forms a three-dimensional fabric which has a uniform longitudinal structure.

Other objectives and advantages of the invention shall become apparent from the following description. An apparatus constructed in accordance with this invention comprises a plurality of braiding elements arranged in a preselected two-dimensional pattern corresponding to the cross-sectional shape of the desired fabric, to form a floating yarn creel. Preferably each braiding element includes a continuous supply of fiber. At a preselected distance away from the creel there is arranged a former plate formed of a plurality of former elements. The former elements are arranged in a pattern essentially identical to the pattern of the braiding elements however the overall cross-sectional dimensions of the former plate are approximately the same as the dimensions of the desired fabric, and generally smaller than the cross-sectional dimensions of the creel. In a specially preferred embodiment of the invention, the apparatus also includes a plurality of beater combs arranged adjacent to the former plate for beating the yarns in the braiding zone to form the fabric. Means are also provided to move the braiding elements, the forming elements and the beating combs in a synchronized movement.

The fabric is braided as follows. Fibers are paid off from the braiding elements through the forming elements. Movement of the braiding and forming elements along preselected paths/ steps causes the fibers to be braided into the fabric. Preferably, the forming and braiding elements are moved in discrete steps, and after one or more such movements, the beating combs are activated for beating the fabric.

Preferably means are provided in the braiding elements for temporarily storing and tensioning extraneous fiber thereby compensating for fiber slack generated by the movement of the braiding elements.

DETAILED DESCRIPTION OF THE INVENTION

It should be understood that in the following description of the invention, directional terms such as above, below and so on are used for illustrative purposes only, and the described apparatus may function in any orientation.

Figure 1:
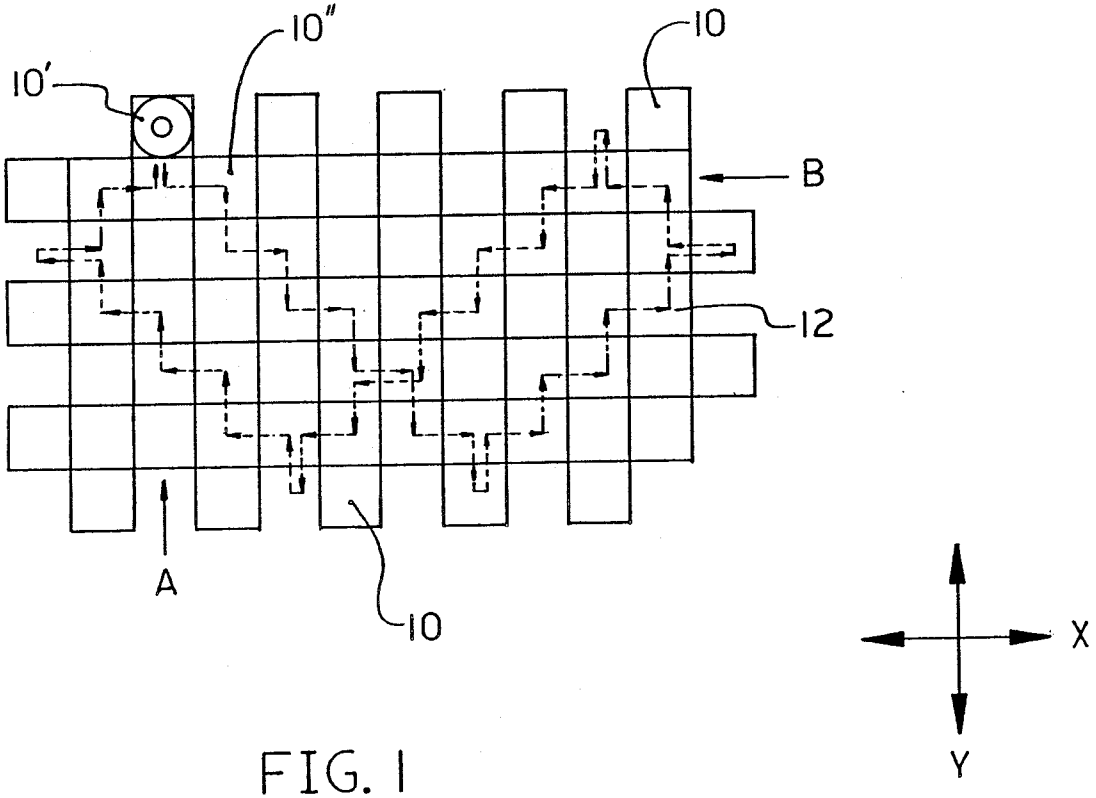
FIG. 1 shows a plan view of a prior art braiding device.

FIG. 1 shows a known structure for braiding three-dimensional fabrics. In this structure, a plurality of braiding elements 10 are disposed in a pattern which defines the cross-sectional shape of the desired fabric. More specifically, the braiding elements in FIG. 1 are arranged to form a rectangular fabric. Obviously, by selecting other patterns for the braiding elements, fabrics of different cross-sectional shapes may be made such as square, I-shaped, T-shaped, C-shaped and so on. The fabric is braided by moving elements 10 along preselected paths, such as path 12. The process may be mechanized by shifting alternatively rows and columns of elements in the X and Y direction shown in FIG. 1. For example, element 10' may be shifted from its position shown in FIG. 1 to the position 10'' by first moving column A in the Y direction and then moving row B in the X direction.

Referring now to FIGS. 2–6, an apparatus for braiding a three-dimensional fabric constructed in accordance with this invention is comprised of: a floating yarn creel 20, a former plate 22, a first actuator control device (or first ACD) 24 controlling the operation of creel 20 and a second actuator control device (second ACD) 26 for controlling the operation of former plate 22. Optionally, for oversized fabrics, a second or intermediate former plate 28 may be disposed between the creel 20 and former plate 22 as shown. Preferably, above the floating former plate 22 a beater comb assembly 30 is provided for beating the fabric right after the yarns exit from former plate 22. The beater comb assembly is driven by a beater drive means 32.

Floating yarn creel 20 comprises a frame 34 which holds a plurality of braiding elements 36. The braiding elements are disposed in a pattern which defines the shape of the desired fabric as described above in conjunction with FIG. 1. Preferably, each braiding element 36 holds a reel of fiber 38 which is paid off in a manner described in more detail below.

ACD 24 includes a pair of pusher arms 40 which, when activated, pushes a row of braiding elements 36 in the X direction. When the pusher arms are released, a pair of return arms 42 cooperate to return the elements 36 to their original positions. Preferably, return arms 42 are biased by springs 44, to eliminate the need for other drive means. Similar pusher and return arms are provided to move the braiding elements in the Y direction. Since these members are similar to the arms 40, 42 their description is omitted.

While the braiding elements are shifted in the pattern shown in FIG. 1 they must be kept in alignment with each other to insure that no blockage occurs. This is accomplished in the present invention by providing at the bottom and top of the braiding elements a plurality of contact wheels 46. Each wheel is rotatably mounted on a support surface of the element 36. As elements 36 pass each other, with each element following its assigned path, the wheels 46 of one element contacts a sidewall 50 to space the elements properly. As the braiding elements pass each other, rotation of wheels 46 eliminates friction and interference between adjacent elements.

Figure 4:
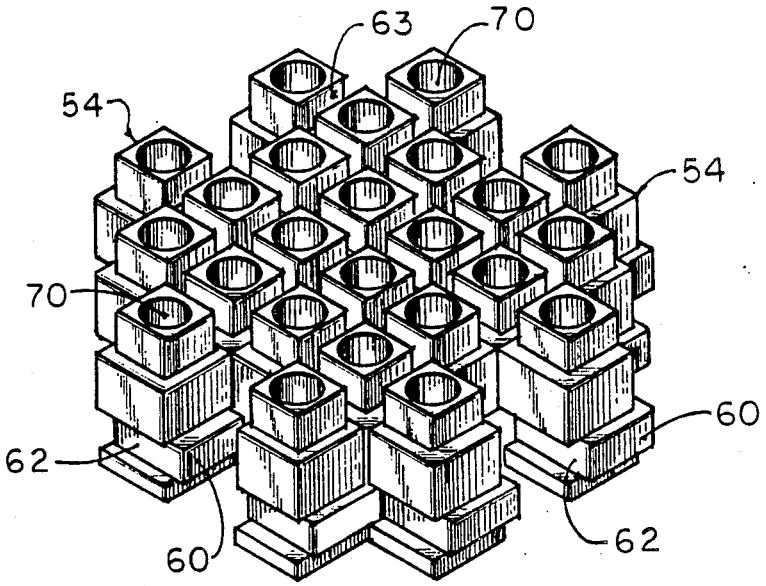
FIG. 4 shows an orthogonal view of a plurality of former plate elements used in the apparatus of FIG. 2.
Figure 5:
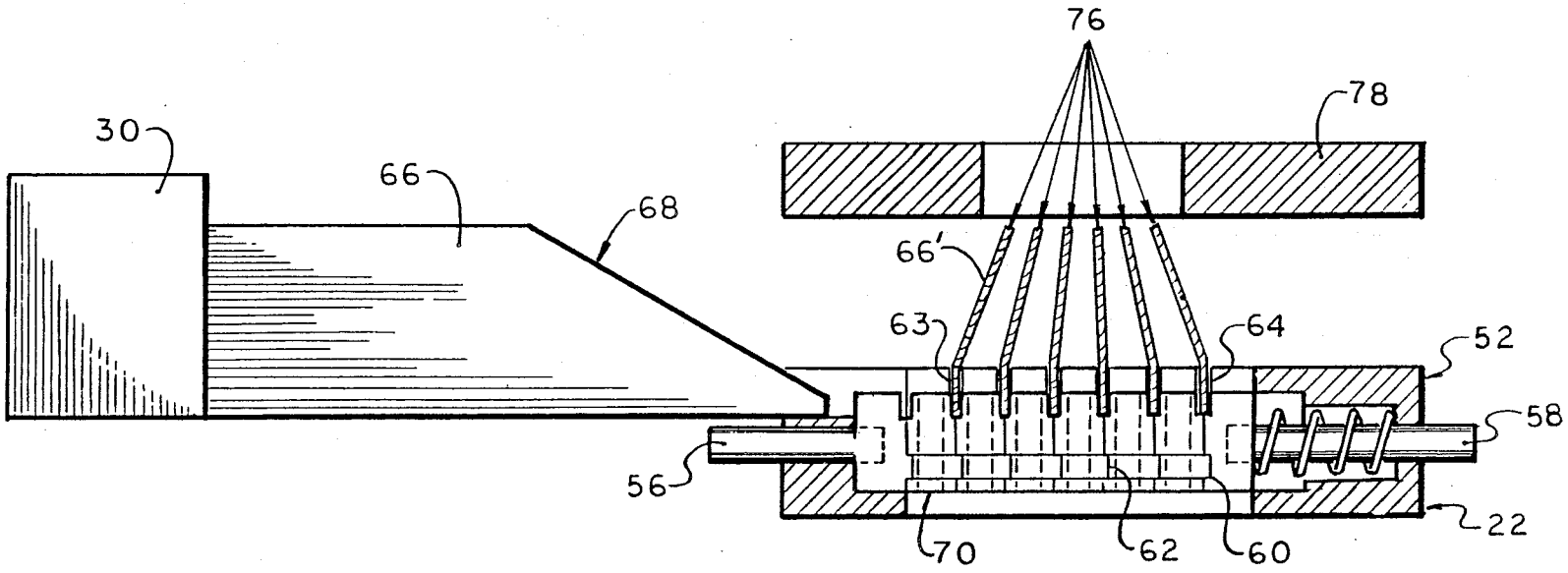
FIG. 5 shows a side-sectional view of the former plate-beater comb assembly for the apparatus of FIG. 2.
Figure 5A:
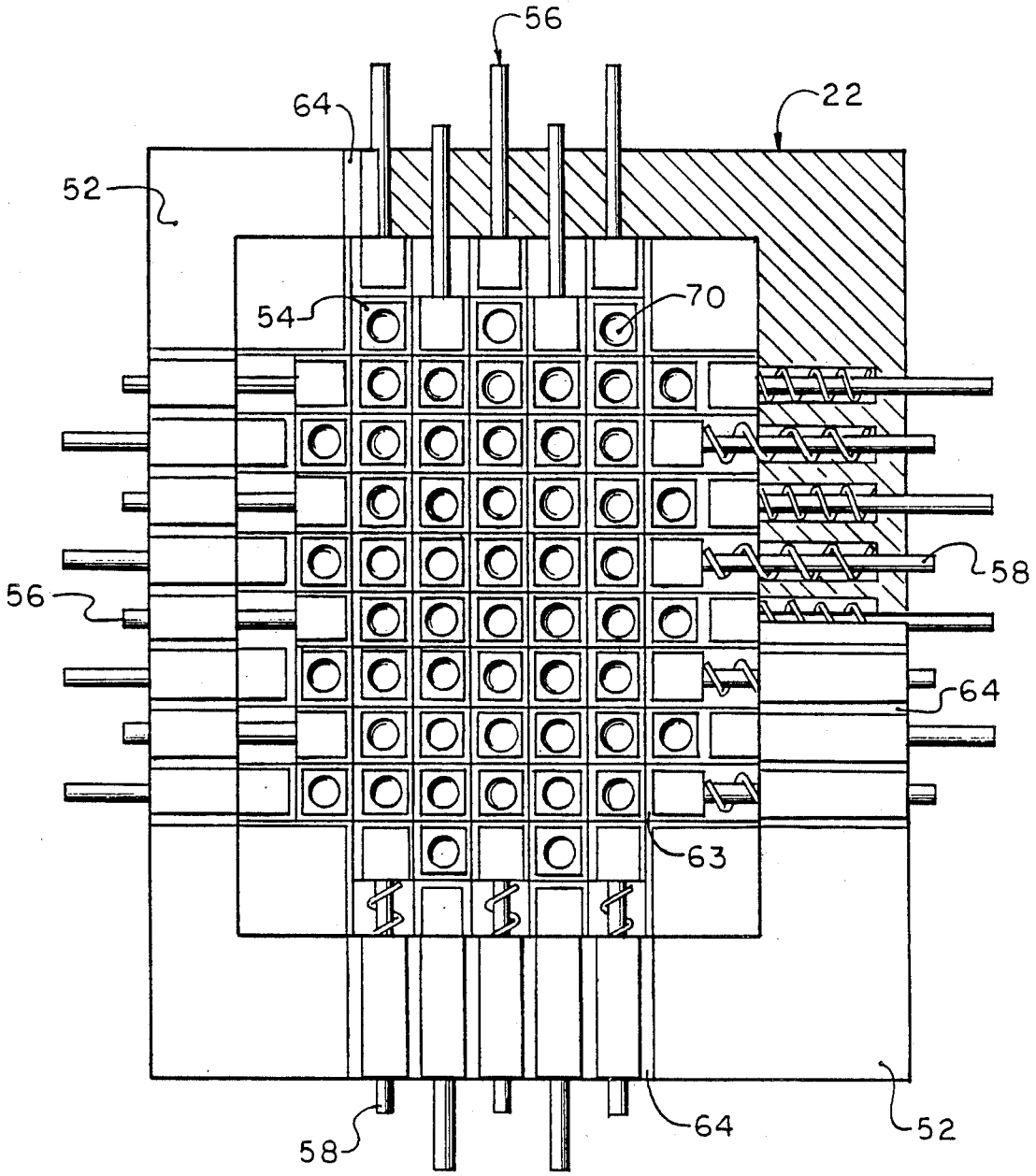
FIG. 5A shows a top view of the floating former plate of FIG. 2.
Figure 6:
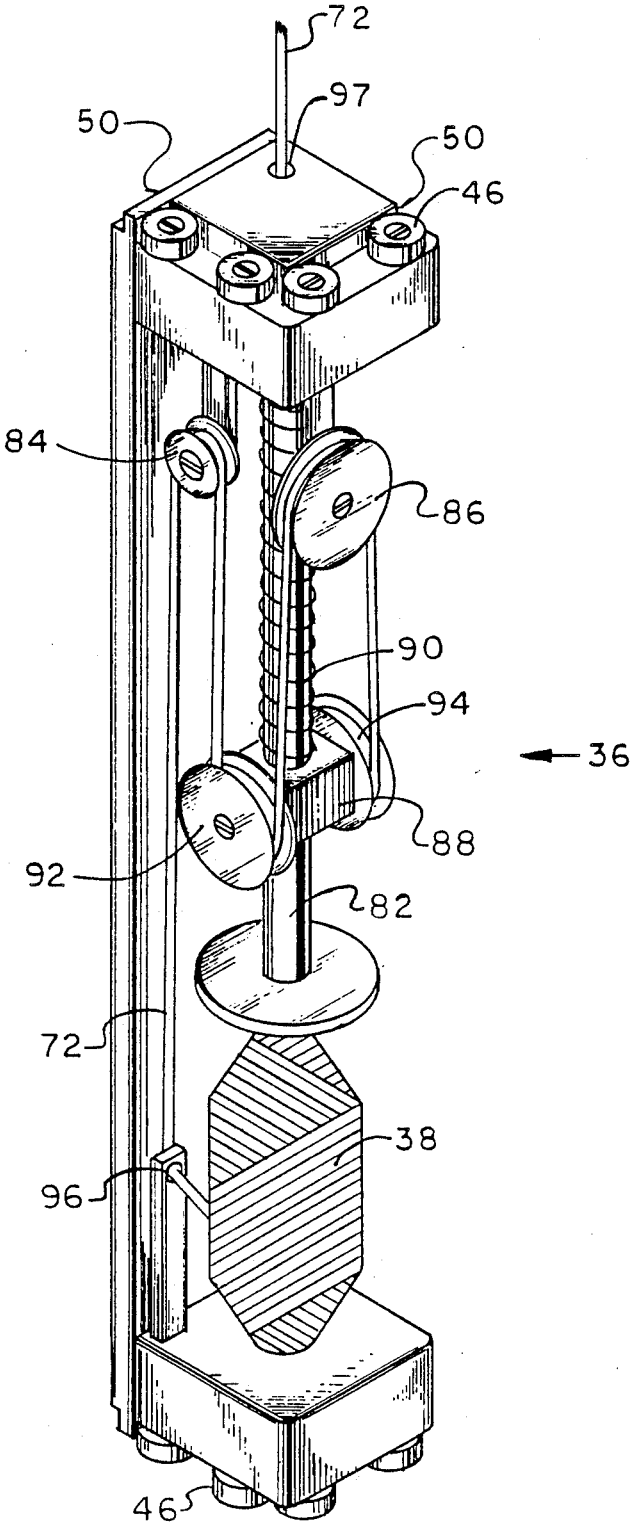
FIG. 6 shows an orthogonal view of a braiding element of FIG. 2.

Former plate 22 comprises a frame 52 which holds a plurality of former elements 54 shown in FIGS. 4 and 5. Elements 54 are disposed in a pattern identical to the pattern of the braiding elements 36. Furthermore each former element 54 corresponds to one of the braiding elements 36. Former elements 54 are moved in paths identical to the paths of the corresponding braiding element 36 by arms 56, 58 activated by second ACD 26. The operation of arms 56 and 58 is identical and synchronized with arms 40 and 42 respectively.

In order to insure that the former elements 54 move easily on their respective paths, these elements are provided with a tongue-and-groove arrangement as follows. Each element 54 has an L-shaped tongue 60 which extends substantially across two adjacent sides of the element. On the opposite sides of the element, there is a corresponding groove 62. The tongues and grooves are arranged and constructed so that as two former elements pass each other they keep their respective positions without interference. This same tongue-and-groove arrangement may also be provided on braiding elements 36.

Figure 2:
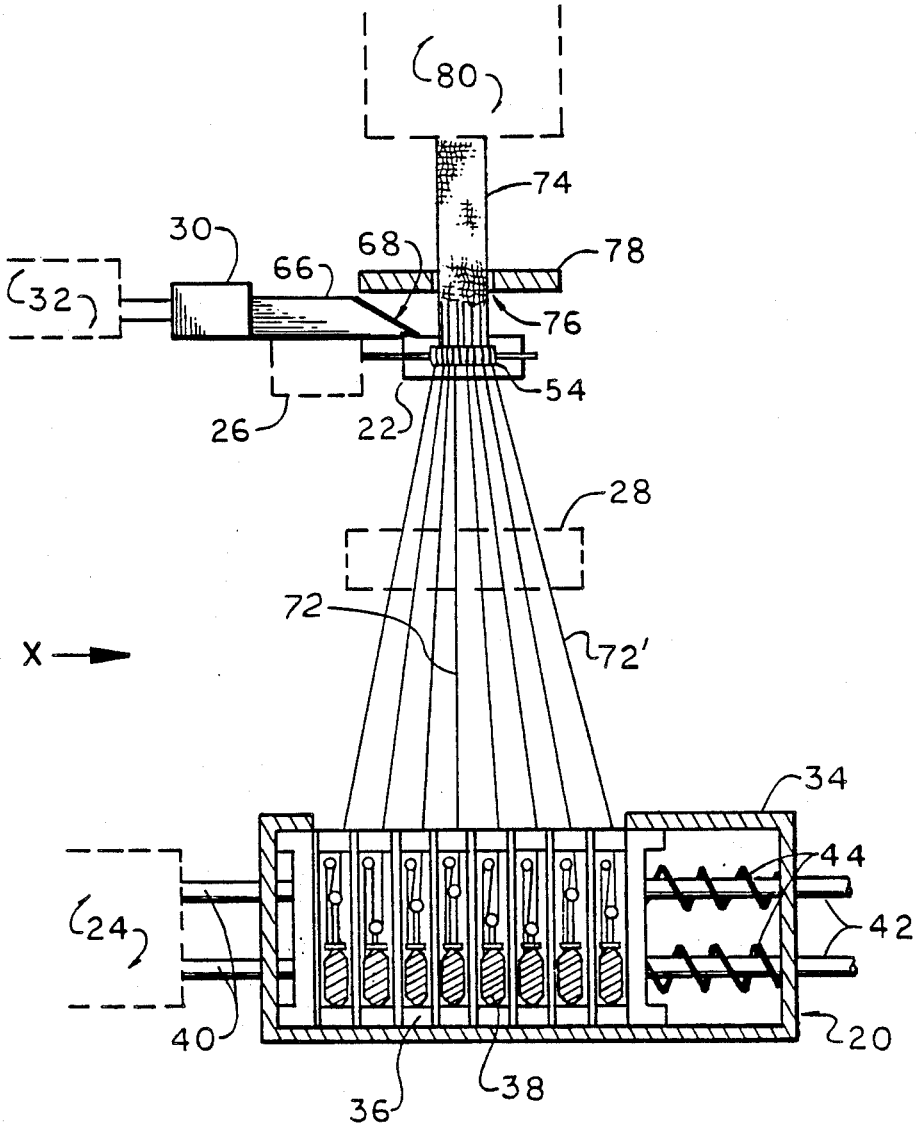
FIG. 2 shows a side-sectional view of a braiding apparatus constructed in accordance with this invention.
Figure 3:
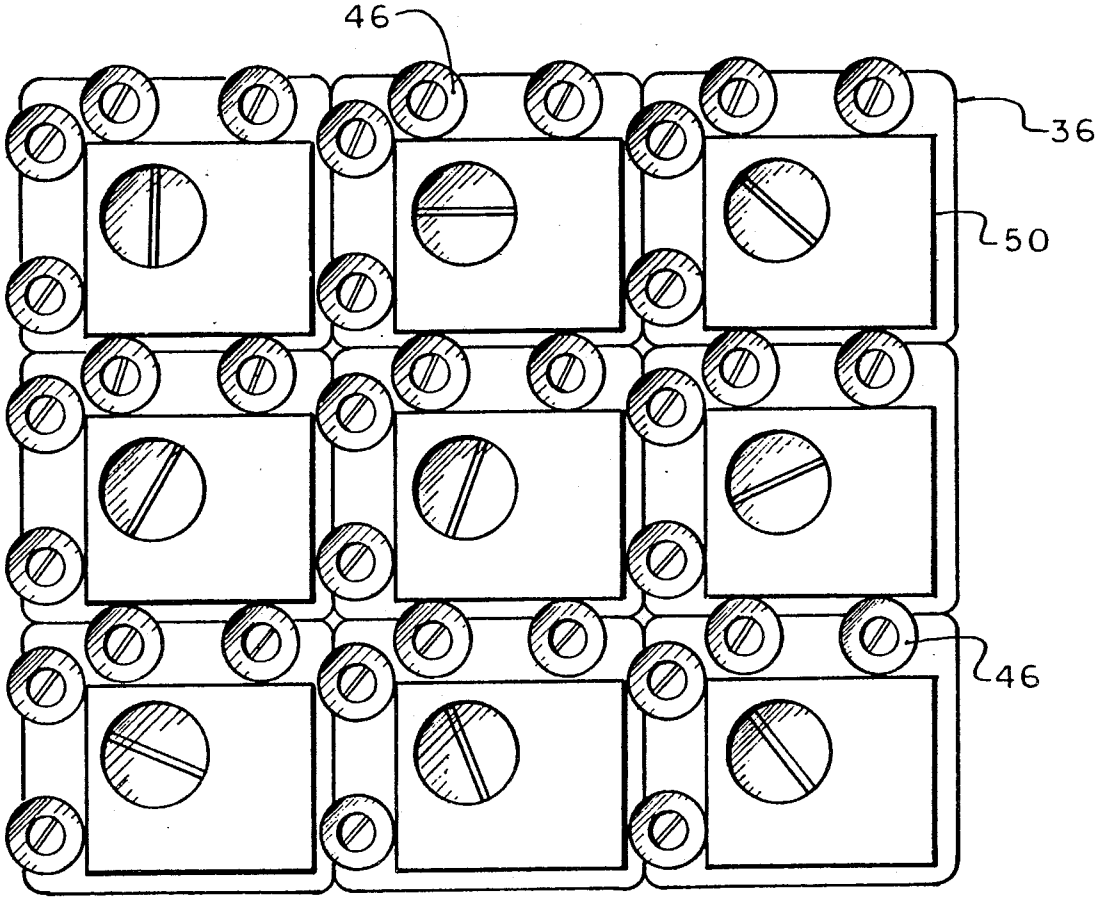
FIG. 3 shows a bottom view of the braiding elements of FIG. 2.

A top section of each former element is narrowed slightly so that channels 63 are defined between each adjacent former element. Slots 64 are cut through frame 52 in line with channels 63 to define a continuous trough. As shown in FIG. 2, each beater comb assembly includes a comb 66' which terminates in a sloped surface 68. Beater drive 32 moves each of the beater combs 66 in a reciprocating motion thereby moving the combs longitudinally through the troughs described above. Each of the former elements is provided with a vertical through-hole 70 shown in FIG. 4.

The apparatus described above operates as follows. Fibers 72, 72' are paid off continuously from reels 38 and pass upwards through through-holes 70 of former elements 54. First and second ACD's 24 and 26 move the brading elements 36 and 54 in synchronized paths thereby braiding the fibers into the fabric 74. The fabric is completely formed at point 76 and passes through a plate 78 on its way to a take-up device 80. Preferably after all braiding and forming the elements have completed a step in the X direction, the beater combs 66 for the Y direction are introduced into the troughs formed on the top of the former elements and pushed through to beat the yarns upward to the fabric formation point. This process insures that the fabric is formed compactly and evenly. The beater combs 66' for the X-direction are moved similarly after all the elements complete a step in the Y direction. The sloped surface 68 on each comb assist the movement of the yarns and insures that the fibers are not ripped by the combs.

It should be appreciated that while the prior art, the formation zone for the fabric extended from the braiding elements to plate 78, in the present invention, the forming zone extends only above forming plate 22. Furthermore, while the floating yarn creel has relatively large cross-sectional dimensions so that the braiding elements 36 can hold the fiber reels 38, plate 22 is much smaller cross-sectional dimensions.

For relatively large fabrics, as the braiding elements move from the outer periphery of the frame toward its center, the fibers from these elements loosen up and could get entangled between the yarn creel and the former plate. This may occur because, as can be seen from FIG. 2, the fibers 72 are shorter than fibers 72'. In order to take up this slack, braiding elements 36 preferably include a reel 38 mounted on a shaft 82. On top of the element 36 there are two fixed pulleys 84, 86. A block 88 is slidably mounted on shaft 82 and is urged downwards toward reel 38 by a compression spring 90. Mounted on block 88 there are two pulleys 92, 94. A fixed eye 96 is used to take the fiber 72 off reel 38. From eye 96, the fiber passes over fixed pulley 84, down to moving pulley 92, up to fixed pulley 86, down to pully 94 and then out through a hole 97. The fiber 72 is initially pretensioned so that it forces block 88 upwards, away from reel 38. As the movement of element 36 tends to slacken fiber 72, block 88 moves downward to keep fiber 72 straight to the former plate eliminating the chance of entanglement. When block 88 reaches its uppermost position—just below reel 86fiber supply 36 is allowed to rotate, paying off additional yarn to permit continuous fabric formation.

Obviously numerous modifications may be made to the invention without departing from its scope as defined in the appended claims.

I claim:

1. An apparatus for braiding a fabric comprising:

a. a plurality of braiding elements constructed and arranged to move in preselected paths in a first plane;

b. a plurality of forming elements constructed and arranged to move in preselected paths in a second plane spaced from said first plane, the movement of each of said forming elements corresponding to the movement of one of said braiding elements;

c. fiber supply means for supplying fibers from said braiding elements through said forming elements, whereby movement of said braiding and forming elements braids said fibers into a fabric.

2. The apparatus of claim 1 wherein said braiding and forming elements are arranged in a preselected pattern, said pattern defining the cross-sectional shape of said fabric.

3. The apparatus of claim 1 further comprising drive means for driving said braiding and forming elements and control means for controlling said drive means.

4. The apparatus of claim 1 wherein said fabric is formed in a forming zone, said forming elements being disposed between said forming zone and said braiding elements.

5. The apparatus of claim 1 further comprising beating means for beating said fabric.

6. An apparatus for braiding a fabric comprising:

a. a yarn creel with a creel frame and a plurality of braiding elements supported by said creel frame;

b. a forming plate spaced from said yarn creel with a plate frame and a plurality of forming elements supported by said plate frame, each forming element corresponding to one of said braiding elements;

c. actuator control means for driving said braiding and forming elements synchronously in preselected paths; and d. fiber supply means for supplying fibers from said braiding elements through said forming elements to a forming zone, whereby said fibers are braided by said braiding and forming means into a fabric in said forming zone.

7. The apparatus of claim 6 further comprising aligning means on said braiding elements.

8. The apparatus of claim 7 wherein said braiding elements have a bottom surface and wherein said aligning means comprise wheels rotatably mounted on said bottom surface.

9. The apparatus of claim 6 wherein said forming elements include aligning means.

10. The apparatus of claim 9 wherein said aligning means include a tongue-and-groove arrangement disposed on the sidewalls of said forming elements.

11. The apparatus of claim 6 further including beating means for beating said fabric in said forming zone.

12. The apparatus of claim 11 wherein said beating means comprise a plurality of beating combs and means for reciprocating said beating combs into and out of said forming zone.

13. The apparatus of claim 12 wherein said forming elements form channels for guiding said beating combs.

14. The apparatus of claim 6 wherein said supply means is disposed in said braiding elements.

15. The apparatus of claim 14 wherein said supply means includes a fiber reel holding a continuous strand of said fiber, and fiber take-up means for taking up excess fiber between said braiding elements and said forming zone.

16. A method for braiding a fabric comprising the steps of:

a. providing a plurality of braiding elements movably disposed in a first plane;

b. providing a plurality of forming elements movably disposed in a second plane, each of said forming elements corresponding to one of said braiding elements;

c. supplying fibers from said braiding elements through said forming elements to a forming zone; and d. moving said braiding and forming elements synchronously in predetermined path to braid said fibers into a fabric.

17. The method of claim 16 further comprising beating said fibers in said forming zone.

18. The method of claim 16 wherein said first and second planes are in parallel.

19. The method of claim 16 wherein said braiding and forming elements are arranged in a preselected pattern which defines the cross-sectional shape of said fabric.

20. The apparatus of claim 6 wherein said yarn creel has larger cross-sectional dimensions then said former plate.

* * * * *